US010840626B2

(12) United States Patent
Li et al.

(10) Patent No.: US 10,840,626 B2
(45) Date of Patent: Nov. 17, 2020

(54) CONDUCTIVE TERMINAL

(71) Applicant: Molex, LLC, Lisle, IL (US)

(72) Inventors: Guo-Li Li, Shanghai (CN); Hao Yin, Shanghai (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/454,071

(22) Filed: Jun. 27, 2019

(65) Prior Publication Data

US 2020/0091642 A1 Mar. 19, 2020

(30) Foreign Application Priority Data

Sep. 13, 2018 (CN) ..... 2018 1 1067178

(51) Int. Cl.
*H01R 13/04* (2006.01)
*H01R 13/11* (2006.01)
(Continued)

(52) U.S. Cl.
CPC ..... *H01R 13/04* (2013.01); *H01R 4/185* (2013.01); *H01R 13/11* (2013.01); *H01R 13/42* (2013.01); *H01R 43/16* (2013.01)

(58) Field of Classification Search
CPC ..... H01R 43/16; H01R 13/11; H01R 4/185; H01R 13/193; H01R 13/04
See application file for complete search history.

(56) References Cited

U.S. PATENT DOCUMENTS 4,047,791 A * 9/1977 Carter ..... H01R 13/193 439/828
4,681,393 A 7/1987 Fukishima et al.
(Continued)

FOREIGN PATENT DOCUMENTS

CN 1149212 A 5/1997
CN 2567812 Y 8/2003
(Continued)

OTHER PUBLICATIONS

First Office action and Search report received for CN application No. 201811067178.2, dated Sep. 2, 2020, 13 pages. (6 pages of english translation and 7 pages of official copy).

*Primary Examiner* — Nguyen Tran
*Assistant Examiner* — Paul D Baillargeon
(74) *Attorney, Agent, or Firm* — Molex, LLC

(57) ABSTRACT

The present disclosure discloses a conductive terminal formed by a metal material integrally punched. The conductive terminal comprises a mating segment positioned at the front and a tail segment positioned at the rear and adapted to connect with a conductive wire. The mating segment comprises a bottom wall, two bending walls, two side walls and two guiding walls, the two bending walls bend upwardly respectively from two side edges of the bottom wall and extend, the two side walls extend upwardly respectively from top edges of the two bending walls, the two guiding walls extend forwardly respectively from front edges of the two side walls toward each other, and each guiding wall has a first tab portion extending downwardly to the front of the bottom wall, and each first tab portion has a guiding edge facing downwardly and inclining upwardly and forwardly from an end close to the bottom wall.

17 Claims, 8 Drawing Sheets

(51) Int. Cl.

| | |
|---|---|
| ***H01R 13/42*** | (2006.01) |
| ***H01R 4/18*** | (2006.01) |
| ***H01R 43/16*** | (2006.01) |

(56) References Cited

U.S. PATENT DOCUMENTS

| | | | | |
|---|---|---|---|---|
| 5,554,056 | A * | 9/1996 | Henricus op ten Berg | H01R 13/112 439/857 |
| 6,217,379 | B1 | 4/2001 | D'Hulster et al. | |
| 6,478,637 | B1 * | 11/2002 | Ohkita | H01R 13/193 439/342 |
| 7,024,767 | B1 | 4/2006 | Lai | |

FOREIGN PATENT DOCUMENTS

| | | | |
|---|---|---|---|
| CN | 101252232 | A | 8/2008 |
| CN | 102810790 | A | 12/2012 |
| CN | 204216263 | U | 3/2015 |
| CN | 205122836 | U | 3/2016 |
| EP | 1096612 | A1 | 5/2001 |
| JP | 2004-022453 | A | 1/2004 |
| JP | 2016-201290 | A | 12/2016 |
| TW | M519825 | U | 4/2016 |
| WO | 2017/191524 | A1 | 11/2017 |

* cited by examiner

CONDUCTIVE TERMINAL

RELATED APPLICATIONS

This application claims priority to Chinese Application No. 201811067178.2, filed on Sep. 13, 2018, which application is incorporated herein by reference in its entirety.

TECHNICAL FIELD

The present disclosure relates to a conductive terminal, particularly relates to a conductive terminal which can prevent a mating terminal from being damaged or poor contact with mating terminal during mating.

BACKGROUND ART

U.S. Pat. No. 4,681,393 discloses a conductive terminal, which discloses that a bottom wall bends upwardly in smooth curve to form a tongue, so that the bottom wall of a male terminal does not have any sharp edge, avoid the sharp edge making insertion of the male terminal into a female terminal being more difficult or cause the female terminal to be damaged during mating. However, such a conductive terminal is complicated in manufacture procedure with formation by punching and bending. Moreover, in such a conductive terminal, an edge of a bending wall positioned between the bottom wall and a side wall still may scratch a contact dimple of the female terminal, which causes the contact dimple of the female terminal to be deformed; and the contact dimple of the female terminal easily latches onto the bending wall of the male terminal positioned between the bottom wall and the side wall while mating, the above two cases may cause poor contact between the male terminal and the contact dimple of the female terminal.

SUMMARY

Therefore, one object of the present disclosure is to provide a conductive terminal which can prevent a mating terminal from being damaged during mating.

Accordingly, in some embodiments, a conductive terminal of the present disclosure is formed by a metal material integrally punched; the conductive terminal extends along a front-rear direction and comprises a mating segment positioned at the front and a tail segment positioned at the rear and adapted to connect with a conductive wire, the mating segment comprises a bottom wall, two bending walls, two side walls and two guiding walls, the bottom wall extends along the front-rear direction, the two bending walls bend upwardly respectively from two side edges of the bottom wall and extend, the two side walls extend upwardly respectively from top edges of the two bending walls, and top edges of the two side walls together define a top opening facing upwardly, the two guiding walls extend forwardly respectively from front edges of the two side walls toward each other, and each guiding wall has a guiding wall body connecting the corresponding side wall and a first tab portion extending downwardly from a bottom of the guiding wall body to the front of the bottom wall, and each first tab portion has a guiding edge facing downwardly and inclining upwardly and forwardly from an end close to the bottom wall.

In some embodiments, the two first tab portions extend downwardly to a position which is the same as a bottom surface of the bottom wall in height.

In some embodiments, the two first tab portions extend downwardly to a position which is lower than a bottom surface of the bottom wall in height.

In some embodiments, each side wall has a side wall body and a second tab portion, the side wall body has a contact portion adapted to contact a mating terminal, the two second tab portions each extend downwardly from the contact portion of the side wall body, and the two second tab portions each extend to a position which is lower than a boundary between the bending wall and the side wall body in height.

Therefore, another object of the present disclosure is to provide a conductive terminal which can avoid poor contact with a mating terminal.

Accordingly, in some embodiments, a conductive terminal of the present disclosure is formed by a metal material integrally punched; the conductive terminal extends along a front-rear direction and comprises a mating segment positioned at the front and a tail segment positioned at the rear and adapted to connect with a conductive wire, the mating segment comprises a bottom wall, two bending walls and two side walls, the bottom wall extends along the front-rear direction, the two bending walls bend upwardly respectively from two side edges of the bottom wall and extending, the two side walls extend upwardly respectively from top edges of the two bending walls, each side wall has a side wall body and a second tab portion, the side wall body has a contact portion adapted to contact a mating terminal, the two second tab portions each extend downwardly from the contact portion of the side wall body, and the two second tab portions each extend to a position which is lower than a boundary between the bending wall and the side wall body in height.

In some embodiments, outer surfaces of the two second tab portions are respectively coplanar with outer surfaces of the two side wall bodies In some embodiments, the mating segment further comprises a bottom opening formed on the bottom wall and the two bending walls and positioned below the contact portions of the two side wall bodies, the two second tab portions are respectively positioned at two side edges of the bottom opening.

In some embodiments, top edges of the two side walls together define a top opening facing upwardly.

The present disclosure at least has the following effects: by means of the two first tab portions extending downwardly from the two guiding walls and having the guiding edges, it avoids the edge of the bottom wall directly scratching the contact dimples of the mating terminal to make the contact dimples deformed while mating, and by means of the two second tab portions extending downwardly from the contact portions of the two side walls, it avoids the contact dimples of the mating terminals latching onto the outer sides of the two bending walls, by means of avoiding the above two cases, it in turn avoids poor contact between the conductive terminal and the mating terminal.

BRIEF DESCRIPTION OF DRAWINGS

Other features and effects of the present disclosure will be apparent from the embodiments with reference to figures, in which.

DETAILED DESCRIPTION OF THE PREFERRED EMBODIMENTS

Figure 1:
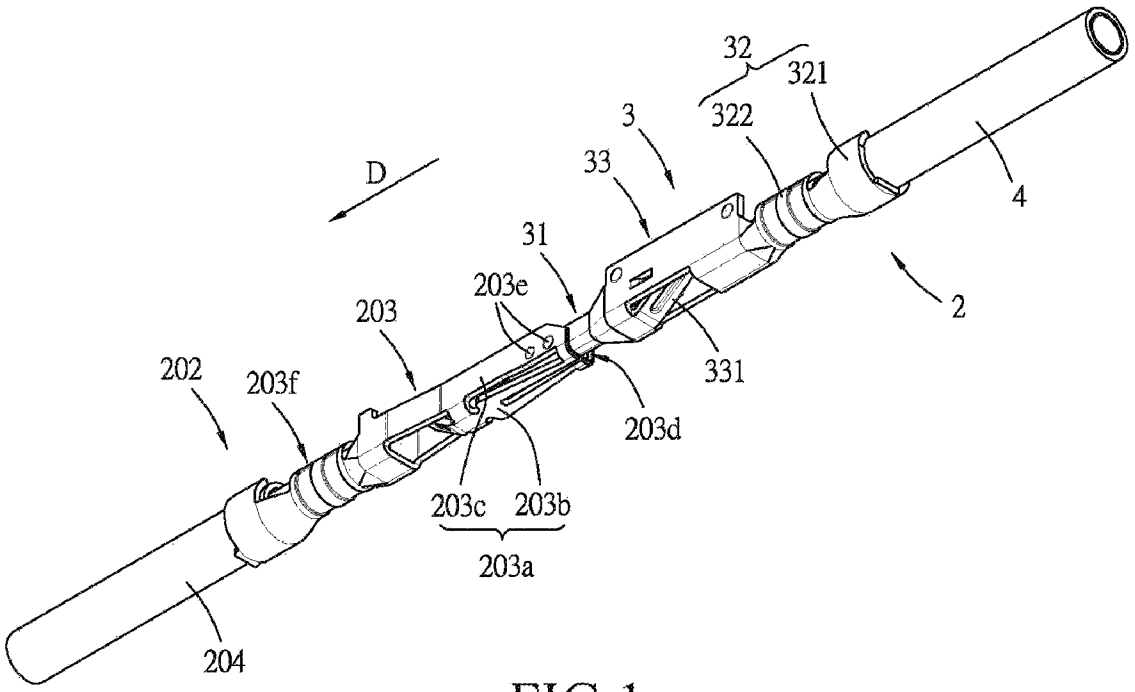
FIG. 1 is a perspective view illustrating that a first embodiment of a conductive terminal of the present disclosure is mated with a mating terminal.
Figure 2:
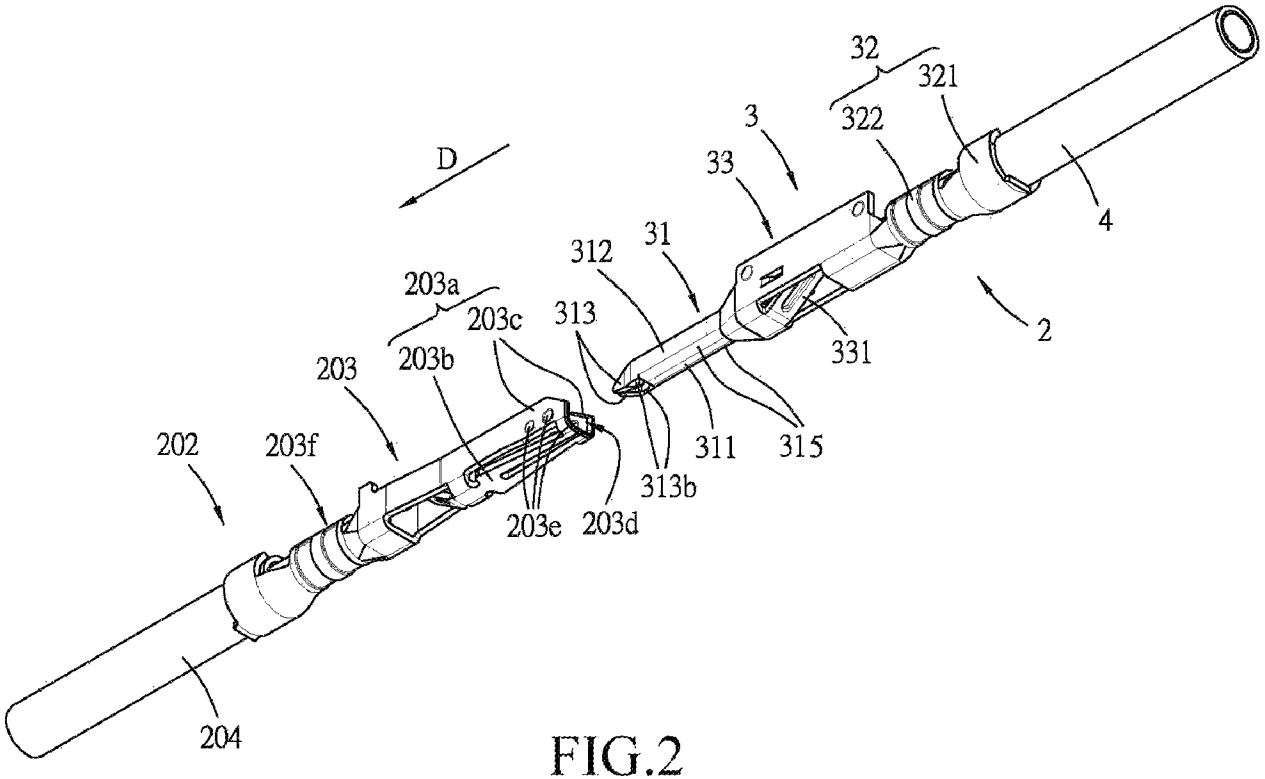
FIG. 2 is an exploded perspective view of FIG. 1.
Figure 3:
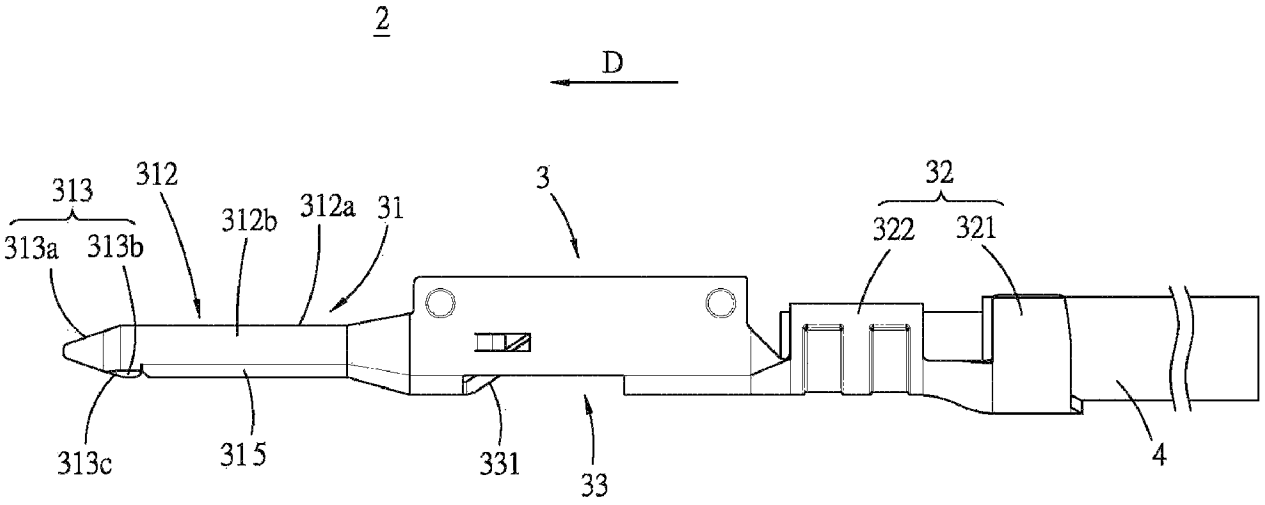
FIG. 3 is a side view of the first embodiment.
Figure 4:
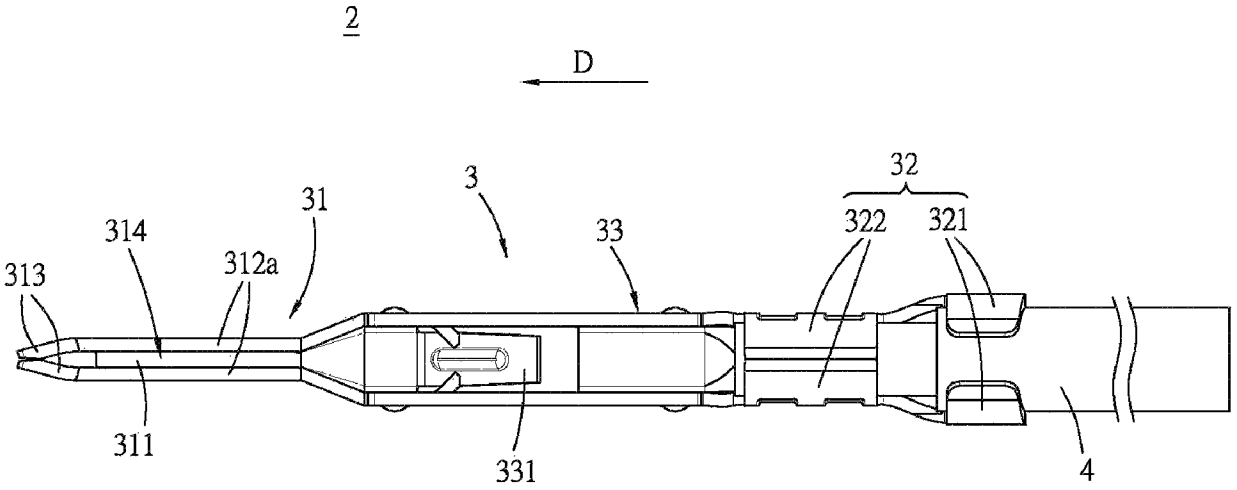
FIG. 4 is a top view of FIG. 3.

Before the present disclosure is described in detail, it should be noted that similar element is represented by the same reference numeral in the following description.

Referring to FIG. 1 to FIG. 4, a first embodiment of a conductive terminal 3 of the present disclosure is adapted to mate with a mating terminal unit 202, the mating terminal unit 202 has a mating terminal 203 and a conductive wire 204 connecting with the mating terminal 203, the mating terminal 203 has a mating segment 203*a* and a tail segment 203*f* configured to provide the conductive wire 204, the mating segment 203*a* has a bottom wall 203*b* and two side walls 203*c* respectively extending upwardly from two side edges of the bottom wall 203*b* and defining a terminal port 203*d* together with the bottom wall 203*b*, each side wall 203*c* has two contact dimples 203*e* formed by punching from the outside toward the inside. The conductive terminal 3 is adapted to constitute a terminal unit 2 together with a conductive wire 4. The conductive terminal 3 is formed by a metal material which is integrally punched by a metal plate process such as punching, bending and the like, the conductive terminal 3 extends along a front-rear direction D and comprises a mating segment 31 positioned at the front, a tail segment 32 positioned at the rear and adapted to connect with a conductive wire 4 and a fixing segment 33 connected between the mating segment 31 and the tail segment 32. The tail segment 32 has two first clamping portions 321 for clamping the conductive wire 4 and two second clamping portions 322 for clamping a copper conductor bared section of the conductive wire 4 so as to make the conductive wire 4 and the conductive terminal 3 electrically connected. The mating segment 31 is used to insert into the terminal port 203*d* of the mating terminal 203, so as to make the conductive terminal 3 and the mating terminal 203 connected.

The mating segment 31 comprises a bottom wall 311, two bending walls 315, two side walls 312 and two guiding walls 313. The bottom wall 311 extends along the front-rear direction D, the two bending walls 315 bend upwardly respectively from two side edges of the bottom wall 311 and extend, the two side walls 312 extend upwardly respectively from top edges of the two bending walls 315. Moreover, each side wall 312 has a side wall body 312*a*, the side wall body 312*a* has a contact portion 312*b* adapted to contact the contact dimples 203*e* of the mating terminal 203, when the conductive terminal 3 is mated with the mating terminal 203, the contact portions 312*b* of the two side walls 312 of the conductive terminal 3 abut against the contact dimples 203*e* of the mating terminal 203 so as to make the conductive terminal 3 and the mating terminal 203 electrically connected. And top edges of the two side walls 312 together define a top opening 314 facing upwardly, in other words, a cross section of the bottom wall 311, the two bending walls 315 and the two side walls 312 of the mating segment 31 perpendicular to the front-rear direction D is a U-shape opened upwardly, which makes acting forces subjected by the two bending walls 315 and is generated from forces the contact dimples 203*e* of the mating terminal 203 applied to the two side walls 312 are identical, moreover, which also can facilitate formation of the mating segment 31 of the conductive terminal 3 by punching and bending.

The two guiding walls 313 extend forwardly respectively from front edges of the two side walls 312 toward each other, and each guiding wall 313 has a guiding wall body 313*a* connecting the corresponding side wall 312 and a first tab portion 313*b* extending downwardly from a bottom of the guiding wall body 313*a* to the front of the bottom wall 311, and each first tab portion 313*b* has a guiding edge 313*c* which faces downwardly and inclines upwardly and forwardly from an end close to the bottom wall 311. By means of the two guiding wall bodies 313*a* extending forwardly toward each other, a front end of the mating segment 31 is slightly pointed cone-shaped, it allows the mating segment 31 of the conductive terminal 3 to easily insert into the terminal port 203*d* of the mating terminal 203. Moreover, by means of the two first tab portions 313*b* extending downwardly from the two guiding walls 313 and having the guiding edges 313*c*, it can avoid an edge of the bottom wall 311 directly scratching the contact dimples 203*e* of the mating terminal 203 during mating, and avoid the contact dimples 203*e* of the mating terminal 203 to generate deformation or depression to make the contact between the contact portion 312*b* of the conductive terminal 3 and the contact dimples 203*e* of the mating terminal 203 poor. In addition, the conductive terminal 3 having the two first tab portions 313*b* is not complicated in manufacturing procedure with formation by punching and bending, which is beneficial for manufacturing. In the first embodiment, two first tab portions 313*b* extend downwardly to a position which is the same as a bottom surface of the bottom wall 311 in height, but in a varied embodiment, the two first tab portions 313*b* extend downwardly to a position which is lower than the bottom surface of the bottom wall 311 in height, that is to say, lower edges of the two first tab portions 313*b* in this varied embodiment protrude downwardly in comparison with the first embodiment, and the two first tab portions 313*b* can more completely block the front of the two side edges of the bottom wall 311; moreover, in another varied embodiment, the two first tab portions 313*b* also may extend downwardly to a position which is higher than the bottom surface of the bottom wall 311 in height, that is to say, the lower edges of the two first tab portions 313*b* in the another varied embodiment retracts upwardly in comparison with the first embodiment, therefore the two first tab portions 313*b* is not limited to the first embodiment.

Figure 5:
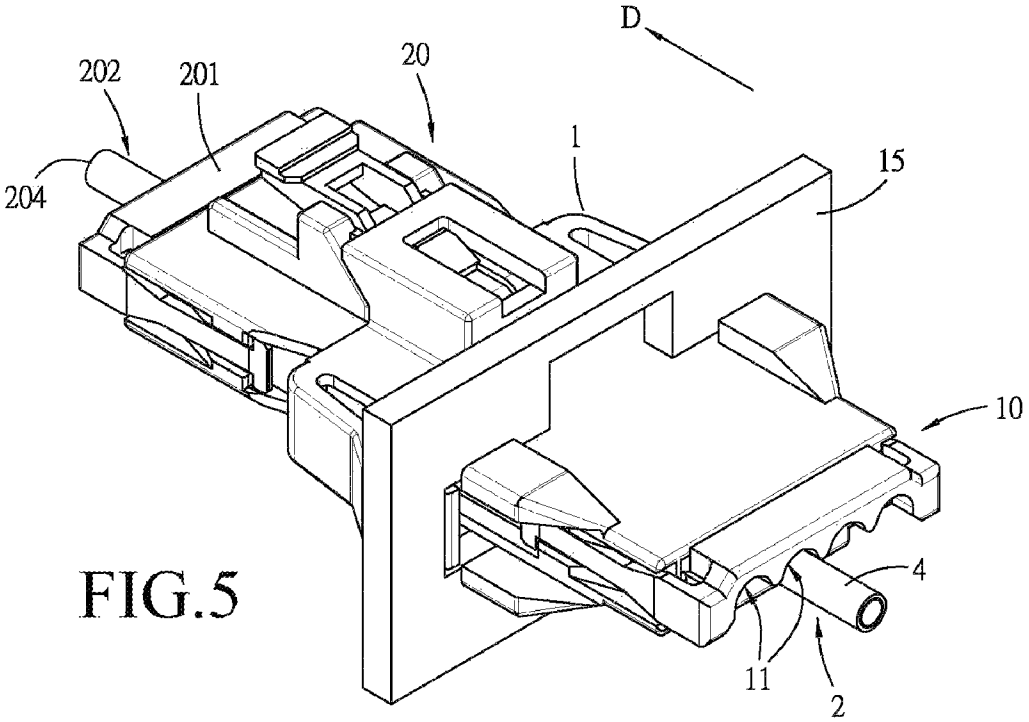
FIG. 5 is a perspective view illustrating that the first embodiment is applied to an electrical connector, in which the electrical connector is mounted to a mounting panel and is mated with a mating connector.
Figure 6:
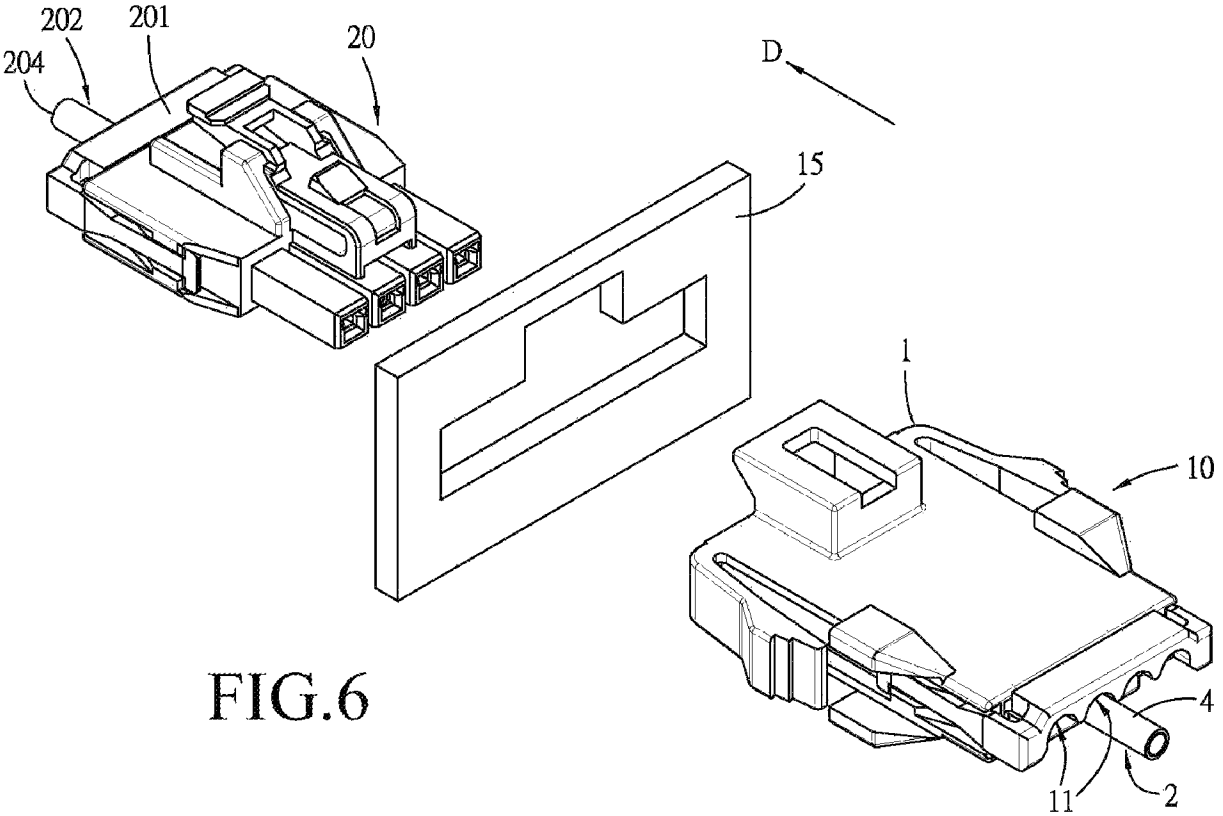
FIG. 6 is an exploded perspective view of FIG. 5.

Referring to FIG. 1, FIG. 5 and FIG. 6, the first embodiment is adapted to be applied in an electrical connector 10, the electrical connector 10 is adapted to pass through and be fixed to a mounting panel 15 and connect with a mating connector 20. The mating connector 20 comprises a mating housing 201 and a plurality of mating terminal units 202 provided in the mating housing 201. The electrical connector 10 comprises an insulative housing 1 and a plurality of terminal units 2. The insulative housing 1 of the electrical connector 10 and the mating housing 201 of the mating connector 20 cooperate with each other, so that when the insulative housing 1 and the mating housing 201 are mated with each other, the terminal units 2 in the insulative housing 1 and the mating terminal units 202 in the mating housing 201 can be cooperatively connected with each other. It should be noted that, for the sake of conciseness, only one terminal unit 2 of the electrical connector 10 and only one mating terminal unit 202 of the mating connector 20 is illustrated in these figures. The insulative housing 1 is formed with a plurality of receiving channels 11 extending along the front-rear direction D. The terminal units 2 are respectively provided to the plurality of receiving channels 11. Moreover, in the first embodiment, the fixing segment 33 has a lock elastic arm 331 obliquely extending upwardly from the front toward the rear, the lock elastic arm 331 is used to cooperatively latch with a stopping protrusion (not shown) formed in the receiving channel 11 of the insulative housing 1, so as to fix the conductive terminal 3 in the receiving channel 11 of the insulative housing 1. But in other embodiment, the fixing segment 33 also may have other latching structure which can be fixed in the receiving channel 11 of the insulative housing 1, even in some varied embodiments, the conductive terminal 3 also may not have the fixing segment 33 but the conductive terminal 3 may be fixed in the receiving channel 11 by means of other well known manners, so it is not limited to the manner of the first embodiment.

Figure 7:
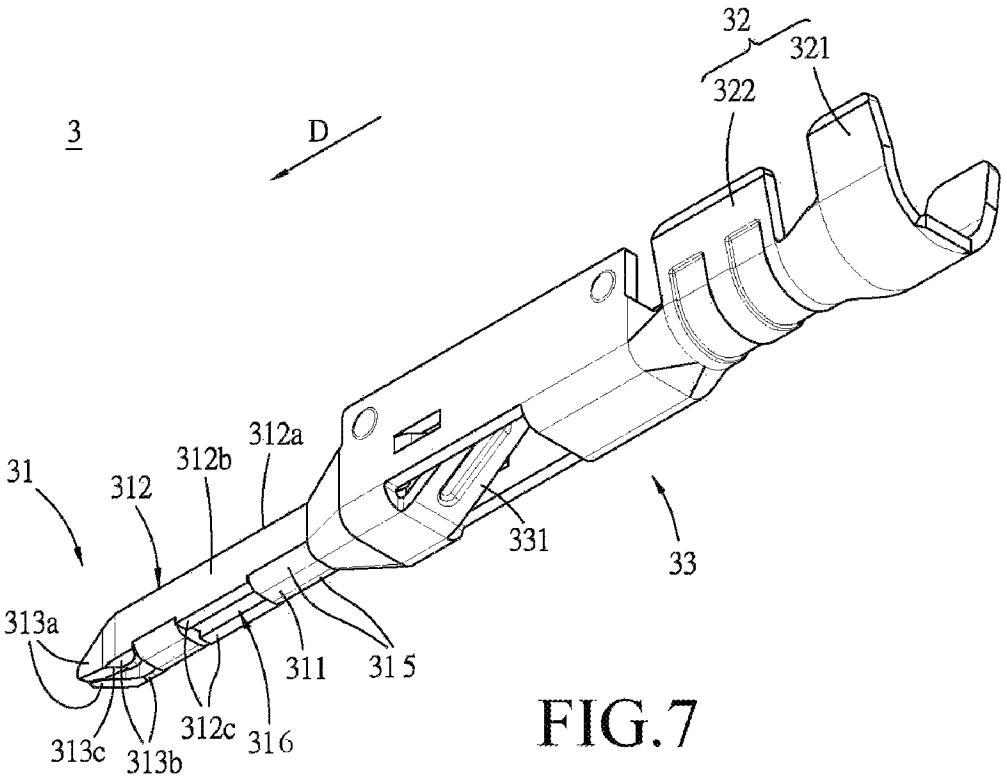
FIG. 7 is a perspective view illustrating a second embodiment of the conductive terminal of the present disclosure.
Figure 8:
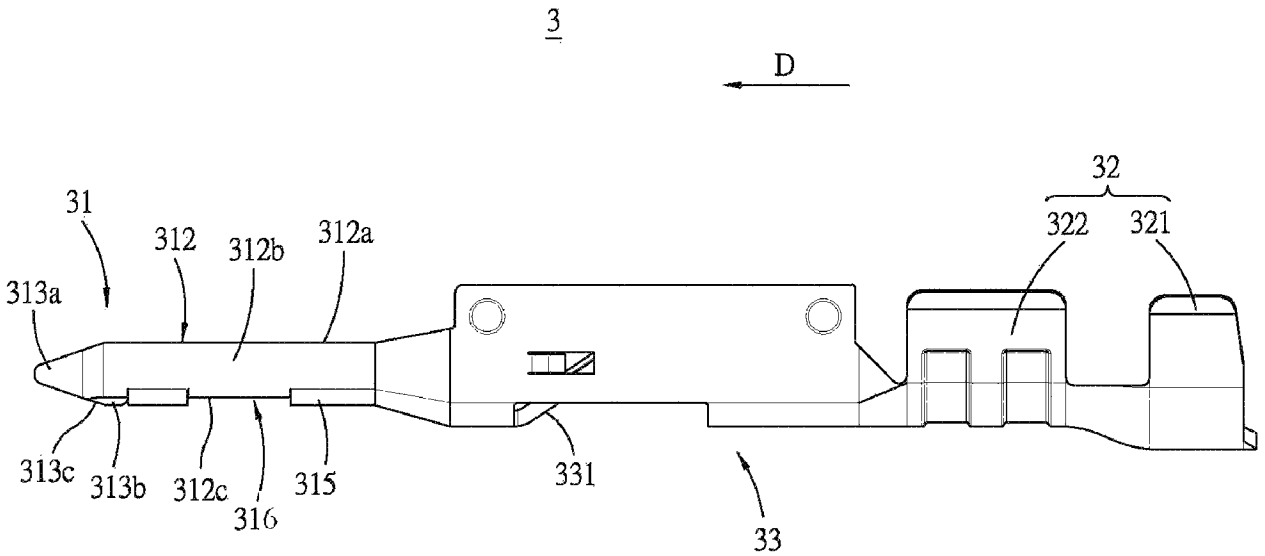
FIG. 8 is a side view of FIG. 7.

Referring to FIG. 7 and FIG. 8, a second embodiment of the conductive terminal 3 of the present disclosure is illustrated. The second embodiment is substantially the same as the first embodiment, however, in the second embodiment, the mating segment 31 further comprises a bottom opening 316 formed on the bottom wall 311. The two bending walls 315 are positioned below the contact portions 312*b* of the two side wall bodies 312*a*. Each side wall 312 further has a second tab portion 312*c* extending downwardly from the contact portion 312*b* of the side wall body 312*a*. The two second tab portions 312*c* are respectively positioned at two side edges of the bottom opening 316, and the two second tab portions 312*c* of the two side walls 312 each extend to a position which is lower than a boundary between the bending wall 315 and the side wall body 312*a* in height. And in the second embodiment, outer surfaces of the two second tab portions 312*c* respectively are coplanar with outer surfaces of the two side wall bodies 312*a*, but it is not limited thereto. By means of the two second tab portions 312*c* extending downwardly from the contact portions 312*b* of the two side walls 312, it can avoid the contact dimples 203*e* of the mating terminal 203 (see FIG. 1) latching onto outer sides of the two bending walls 315 to generate poor contact with the conductive terminal 3. It should be noted that, in a varied embodiment, the conductive terminal 3 also may only have the second tab portion 312*c* but does not have the first tab portion 313*b*, but it is not limited to the above embodiment.

In conclusion, in the conductive terminal 3 of the present disclosure, by means of the two first tab portions 313*b* extending downwardly from the two guiding walls 313 and having the guiding edges 313*c*, it avoids the edge of the bottom wall 311 directly scratching the contact dimples 203*e* of the mating terminal 203 to make the contact dimples 203*e* deformed while mating, and by means of the two second tab portions 312*c* extending downwardly from the contact portions 312*b* of the two side walls 312, it avoids the contact dimples 203 of the mating terminals 203*e* latching onto the outer sides of the two bending walls 315, by means of avoiding the above two cases, it in turn avoids poor contact between the conductive terminal 3 and the mating terminal 203.

However, the above description is only for the embodiments of the present disclosure, and the implementing scope of the present disclosure is not limited thereto, and all the simple equivalent changes and modifications according to the scope of the claims and the specification of the present disclosure are still fallen within the scope of the present disclosure.

The invention claimed is:

1. A conductive terminal, formed by a metal material integrally punched, the conductive terminal extending along a front-rear direction and comprising:

a mating segment positioned at the front and a tail segment positioned at the rear and adapted to connect with a conductive wire, the mating segment comprising a bottom wall, two bending walls, two side walls and two guiding walls, the bottom wall extending along the front-rear direction, the two bending walls bending upwardly respectively from two side edges of the bottom wall, the two side walls extending upwardly respectively from top edges of the two bending walls, and top edges of the two side walls together defining a top opening facing upwardly, the two guiding walls extending forwardly respectively from front edges of the two side walls toward each other, and each guiding wall having a guiding wall body connecting to the corresponding side wall and a first tab portion extending downwardly from a bottom of the guiding wall body to the front of the bottom wall, and each first tab portion having a guiding edge facing downwardly and inclining upwardly and forwardly from an end close to the bottom wall.

2. The conductive terminal of claim 1, wherein the two first tab portions extend downwardly to a position which is the same as a bottom surface of the bottom wall in height.

3. The conductive terminal of claim 1, wherein the two first tab portions extend downwardly to a position which is lower than a bottom surface of the bottom wall in height.

4. The conductive terminal of claim 1, wherein each side wall has a side wall body and a second tab portion, the side wall body has a contact portion adapted to contact a mating terminal, the two second tab portions each extend downwardly from the contact portion of the side wall body, and the two second tab portions each extend to a position which is lower than a boundary between the bending wall and the side wall body in height.

5. The conductive terminal of claim 1, wherein the mating segment further comprises a bottom opening formed on the bottom wall.

6. The conductive terminal of claim 1, further comprising a fixing segment which is provided between the mating segment and the tail segment, wherein the fixing segment is configured to fix the conductive terminal to an insulative housing of an electrical connector.

7. The conductive terminal of claim 6, wherein the fixing segment has a lock elastic arm which is configured to cooperatively latch with a stopping protrusion formed in the insulative housing.

8. A conductive terminal, formed by a metal material integrally punched, the conductive terminal extending along a front-rear direction and comprising:

a mating segment positioned at the front and a tail segment positioned at the rear, the tail segment having at least one clamping, portion which is configured to clamp at least a Portion of a conductive wire, the mating segment comprising a bottom wall, two bending walls and two side walls, the bottom wall extending along the front-rear direction, the two bending walls bending upwardly respectively from two side edges of the bottom wall, the two side walls extending upwardly respectively from top edges of the two bending walls, each side wall having a side wall body and a second tab portion, the side wall body having a contact portion adapted to contact a mating terminal, the two second tab portions each extending downwardly from the respective contact portion of the side wall body, and the two second tab portions each extending to a position which is lower than a boundary between the bending wall and the side wall body in height.

9. The conductive terminal of claim 8, wherein outer surfaces of the two second tab portions are respectively coplanar with outer surfaces of the two side wall bodies.

10. The conductive terminal of claim 8, wherein the mating segment further comprises a bottom opening formed on the bottom wall and the two bending walls and positioned below the contact portions of the two side wall bodies, the two second tab portions are respectively positioned at two side edges of the bottom opening.

11. The conductive terminal of claim 8, wherein top edges of the two side walls together define a top opening facing upwardly.

12. The conductive terminal of claim 8, wherein the contact portion of each side wall body is configured to be provided on an outer surface of the side wall body.

13. The conductive terminal of claim 8, wherein the mating segment further comprises a bottom opening formed on the bottom wall.

14. The conductive terminal of claim 8, wherein the at least one clamping portion of the tail segment comprises at least one first clamping portion which is configured to clamp the conductive wire and at least one second clamping portion which is configured to clamp a conductor bared section of the conductive wire.

15. The conductive terminal of claim 8, further comprising a fixing segment which is provided between the mating segment and the tail segment, wherein the fixing segment is configured to fix the conductive terminal to an insulative housing of an electrical connector.

16. The conductive terminal of claim 15, wherein the fixing segment has a lock elastic arm which is configured to cooperatively latch with a stopping protrusion formed in the insulative housing.

17. The conductive terminal of claim 8, wherein the mating segment has at least one guiding wall extending forwardly from a front edge of at least one of the two side walls.

* * * * *